US009746273B2

(12) United States Patent
Lowrance et al.

(10) Patent No.: US 9,746,273 B2
(45) Date of Patent: Aug. 29, 2017

(54) RECOIL SIMULATOR AND METHOD FOR AN IMITATION MACHINE GUN

(71) Applicant: Pathfinder Systems, Inc., Arvada, CO (US)

(72) Inventors: Kyle Lowrance, Westminster, CO (US); C. Ross Cohlmia, Arvada, CO (US); Jeffrey Scott Kline, Erie, CO (US); Garrett Fritz, Las Vegas, NV (US); Bryan Harter, Lafayette, CO (US)

(73) Assignee: Pathfinder Systems, Inc., Lakewood, CO (US)

( * ) Notice: Subject to any disclaimer, the term of this patent is extended or adjusted under 35 U.S.C. 154(b) by 154 days.

(21) Appl. No.: 14/541,515

(22) Filed: Nov. 14, 2014

(65) Prior Publication Data

US 2016/0169609 A1 Jun. 16, 2016

(51) Int. Cl.
*F41A 33/06* (2006.01)

(52) U.S. Cl.
CPC ..... *F41A 33/06* (2013.01)

(58) Field of Classification Search
CPC ..... F41A 33/06
USPC ..... 434/11, 16, 18
See application file for complete search history.

(56) References Cited

U.S. PATENT DOCUMENTS 2,375,004 A 5/1945 Knowles
2,398,813 A * 4/1946 Swisher ..... F41C 27/00 124/3
2,486,008 A * 10/1949 Cutler ..... F41A 33/00 434/24
4,007,934 A * 2/1977 Ochi ..... F41A 33/00 434/18
4,079,525 A * 3/1978 Linton ..... F41A 33/06 434/18
4,302,190 A * 11/1981 Shaw ..... F41A 33/06 434/18
4,321,043 A * 3/1982 Grimmer ..... F41A 33/00 434/18
4,804,325 A * 2/1989 Willits ..... F41G 3/2661 434/19
5,857,854 A * 1/1999 Kwalwasser ..... F41A 33/06 434/18
7,581,954 B2 * 9/2009 Schavone ..... F41B 11/51 124/74
8,356,995 B2 * 1/2013 Lvovskiy ..... F41A 33/06 434/11
8,496,479 B2 * 7/2013 Rauser ..... F41A 33/06 434/11
8,690,575 B1 * 4/2014 Gurule ..... F41A 33/06 434/11
2013/0316308 A1 * 11/2013 Monti ..... F41A 33/06 434/16

* cited by examiner

*Primary Examiner* — Kurt Fernstrom

(74) *Attorney, Agent, or Firm* — Dorr, Carson & Birney PC

(57) ABSTRACT

The recoil of an actual machine gun is simulated in an imitation machine gun by converting linearly reciprocating movement of an output shaft of a linear actuator into reciprocating movement of all or part of the imitation machine gun.

14 Claims, 13 Drawing Sheets

RECOIL SIMULATOR AND METHOD FOR AN IMITATION MACHINE GUN

This invention relates generally to training persons to operate an actual machine gun by using an imitation or simulated machine gun. More particularly, the present invention relates to a new and improved recoil simulator mechanism and method which simulates, in the imitation machine gun, the recoil created by firing rounds of ammunition from an actual machine gun.

BACKGROUND OF THE INVENTION

In modern circumstances, it is difficult and expensive to train soldiers and military defense personnel in the effective use of high-powered rapid-fire machine guns, by simply allowing such individuals to practice using the actual guns with live ammunition. The ammunition rounds are expensive, for example costing up to five dollars per round. The cost of ammunition alone quickly multiplies when it is recognized that a typical machine gun is capable of firing hundreds of rounds per minute. Adequate space for a practice gunnery range may not be readily available. Increased cost is involved in transporting the personnel and the equipment to suitable remote locations where adequate gunnery practice can be performed. Safety is always a major consideration when live ammunition rounds are fired, both to military personnel involved in gunnery practice and to non-military personnel who may be adjacent to the gunnery range. It is difficult to instruct during a live ammunition training session due to the noise and safety considerations involved when others are involved in similar, close-by, live-ammunition practice activities. Furthermore, it may be difficult to vary the targets quickly at a live-ammunition gunnery range.

These problems and practical constraints are exacerbated when training individuals to shoot from a moving vehicle such as a helicopter. If live ammunition practice is attempted from a moving helicopter, a large space is required in order to maneuver the helicopter and to provide targets and adequate safety barriers, especially when multiple individuals are involved in similar simultaneous training exercises. As a result, live gun practice requires considerable space, and the cost of operating the helicopter greatly multiplies the overall training cost.

Because of these and other considerations, simulated weapon training programs have been developed for teaching purposes. Such training programs use imitation machine guns which closely simulate the sensational aspects and the mechanical and physical requirements of firing actual machine guns. Firing is simulated by reproducing effects which mirror the sensual perceptions associated with firing the actual machine gun. The environment and the targets are electronically displayed, allowing them to be more easily varied and to simulate movement of the targets and the machine gun. The trajectory of the simulated bullet fired is also calculated. In those cases where the simulated fired bullet emulates a tracer, the trajectory of that simulated bullet is also displayed in the surrounding environment.

For helicopter gun training, the imitation machine gun is mounted in an open door of an imitation portion of the helicopter fuselage. The environment and the targets are displayed outside of the open door. The portion of the imitation helicopter fuselage is moved or shaken in a manner similar to the movement of an actual helicopter in flight while the display of the surrounding environment and the targets are moved to simulate the flight path of the helicopter.

Simulated weapons training programs offer other benefits. Environments of remote areas of the world may be simulated, thereby providing training exposure to such environments prior to actually deploying the military personnel to those locales. The accuracy of the training program and the abilities of the individuals trained may be assessed. The accuracy in shooting, and the success of the training itself, is gauged by comparing the calculated, projected trajectory of the simulated bullets relative to the displayed targets. The number of simulated rounds fired may also be counted to evaluate the efficiency of the individual doing the shooting. Other factors can be evaluated from the vast amount of information available from such computer-based simulated weapons training programs.

Of course, to be effective for training purposes, it is necessary to create a realistic simulated environment and a realistic experience of firing the imitation machine gun. Such simulation is accomplished principally by multiple computer systems which are programmed to perform their specific simulation activities in coordination with each other. In the end, the capability of the simulated weapons training program to imitate the actual use of the actual machine gun in an actual environment is the ultimate measure of effective and successful training.

Accurately simulating the firing of an actual machine gun involves duplicating the recoil or reactive impact created by firing each ammunition round. A momentary rearward impact occurs in reaction to the forward acceleration of the bullet moving out of the barrel and in reaction to a reciprocating movement of an internal bolt of the gun. The explosive force from firing the round drives the bolt rearward against the force of a bolt actuating spring. The rearward movement of the bolt automatically ejects the spent casing, withdraws the next live round from the ammunition belt, expels a connection link which joined the withdrawn round to the next round of the ammunition belt, positions the withdrawn round on the bolt for loading and firing, and advances the ammunition belt to locate the next round to undergo similar actions after active round has been fired. Depressing the trigger enables the compressed bolt actuating spring to drive the bolt forward to load the round into a firing chamber and then fire that loaded round. The pressure from the exploded round drives the bolt rearwardly against the compression force of the bolt actuating spring. The sequence of events continues in the same manner with each subsequent pull of the trigger, or the sequence of events continues repetitively and continuously while the trigger remains depressed. The individual operating the gun feels the sensation of this reaction as recoil of the machine gun.

Larger and higher power ammunition rounds create greater reactive recoil. Since the capability to load and fire each ammunition round is set or adjusted by the force of the bolt actuating spring and other physical components of the actual machine gun, the frequency and strength of the sequential recoil impacts may vary according to the type of ammunition and the spring characteristics of the bolt activating spring.

In a imitation machine gun, the repetitive recoil impacts of firing ammunition rounds are simulated by a recoil simulation device. The recoil simulation device generates the reactive impact that simulates the recoil impact of firing a live ammunition round and reciprocating the bolt in an actual machine gun. One previous imitation machine gun reciprocates an internal bolt when firing a simulated round, to contribute to generating the recoil effect.

The imitation machine gun should emulate the functionality of the actual machine gun to the greatest extent possible. Individuals become accustomed to the imitation machine gun due to the amount of simulated training received. Because of the familiarity gained from training with the imitation machine gun, use of the imitation machine gun should be essentially the same as the use of the actual machine gun; otherwise, differences in functionality or performance create unexpected problems or difficulties when using the actual machine gun.

Accurately simulating the effect of using an actual machine gun means that using the imitation machine gun should not require additional actions which are not involved in using the actual machine gun. Extra external parts, such as hoses which carry hydraulic or pneumatic fluid for operating some feature of the imitation machine gun, cause a lack of familiarity or awkwardness when it comes to using the actual machine gun. Extra external parts may also create an expectation of a certain feel, appearance and operating style that are not present when using the actual machine gun. Known prior art recoil simulator mechanisms suffer from the disadvantages of requiring extra external parts and requiring extra actions not involved in using an actual machine gun. Known prior art recoil mechanisms also create sensations which are not faithful reproductions of the sensations created when using the actual machine gun. These extra external parts, actions and sensations lead to a potential for degraded performance when using the actual machine gun.

SUMMARY OF THE INVENTION

In accordance with the above described and other related considerations, a recoil simulator of the present invention overcomes the problems and deficiencies of known previous recoil simulators in imitation machine guns. The amount of impact created by the recoil, the frequency of the impacts, and other characteristics associated with the impacts are easily adjusted to accommodate different levels of power from the ammunition rounds which are fired stimulatively and to accommodate different operating characteristics of the machine gun. The recoil simulator is concealed and functional within the imitation machine gun in a way which does not create significant differences in functionality, performance, and look and feel of the imitation machine gun relative to the actual machine gun. No external additional parts appear on the imitation machine gun to otherwise create subtle differences between the imitation and actual machine guns. The functional aspects of the recoil simulator are controlled electrically and straightforwardly by computer systems of the entire simulated weapons training program. The components used in the recoil simulator are capable of reliable and intensive use without premature or unexpected failure, thereby facilitating the effectiveness of the imitation machine gun for training purposes.

The recoil simulator is used with a split cradle assembly which supports part or all of the imitation machine gun. The split cradle assembly has relatively movable and stationary cradle pieces. The stationary cradle piece is adapted to be connected to a stationary support, and the movable cradle piece is adapted to be connected to part or all of the imitation machine gun. The movable cradle piece and the attached part or parts of imitation machine gun are moved relative to the stationary cradle piece in a reciprocating movement parallel to a barrel of the imitation machine gun, similar to the recoil movement which occurs with firing an actual machine gun. A controllable mechanism, such as a linear actuator, linearly extends and retracts an output shaft which is operatively connected to move the movable cradle piece and create the reciprocating movement that simulates the recoil movement in an actual machine gun.

The invention also involves a method of simulating recoil in an imitation machine gun. A movable cradle piece is connected to part or all of the imitation machine gun. A stationary cradle piece is connected to a stationary support. The movable cradle piece is moved relative to the stationary cradle piece with relative linear longitudinal reciprocating movement parallel to a barrel of the imitation machine gun. An output shaft is linearly extended and retracted, and that linear movement is applied to the part or parts of the imitation machine gun connected to the movable cradle piece to simulate the recoil the imitation machine gun.

The invention may also involve some or all of the following subsidiary aspects. The entire imitation machine gun, or only a handle and trigger assembly of the imitation machine gun, may be reciprocated to simulate the recoil. The imitation machine gun may include an ammunition box support tray which extends transversely to the longitudinal dimension of the imitation machine gun, and the transverse linear extension and retraction of the output shaft is accomplished by a linear actuator which is positioned and hidden below the ammunition box support tray. The direction, rate and force-movement characteristics of the output shaft are controlled by an electric motor in response to an electric current waveform having characteristics to create the desired direction, rate and/or force-movement characteristics. A bell crank may convert the transverse linear movement of the output shaft into longitudinal linear movement of the drive shaft. The movable and stationary cradle pieces may utilize a bearing block having grooves and a rail structure having rails meshed with the grooves to establish the reciprocating movement.

Other aspects and features of the invention, and a more complete appreciation of the present invention, as well as the manner in which the present invention achieves the above and other improvements, can be obtained by reference to the appended claims and the following detailed descriptions of presently preferred embodiments of the invention, taken in connection with the accompanying drawings which are briefly summarized below.

DETAILED DESCRIPTION

Figure 1:
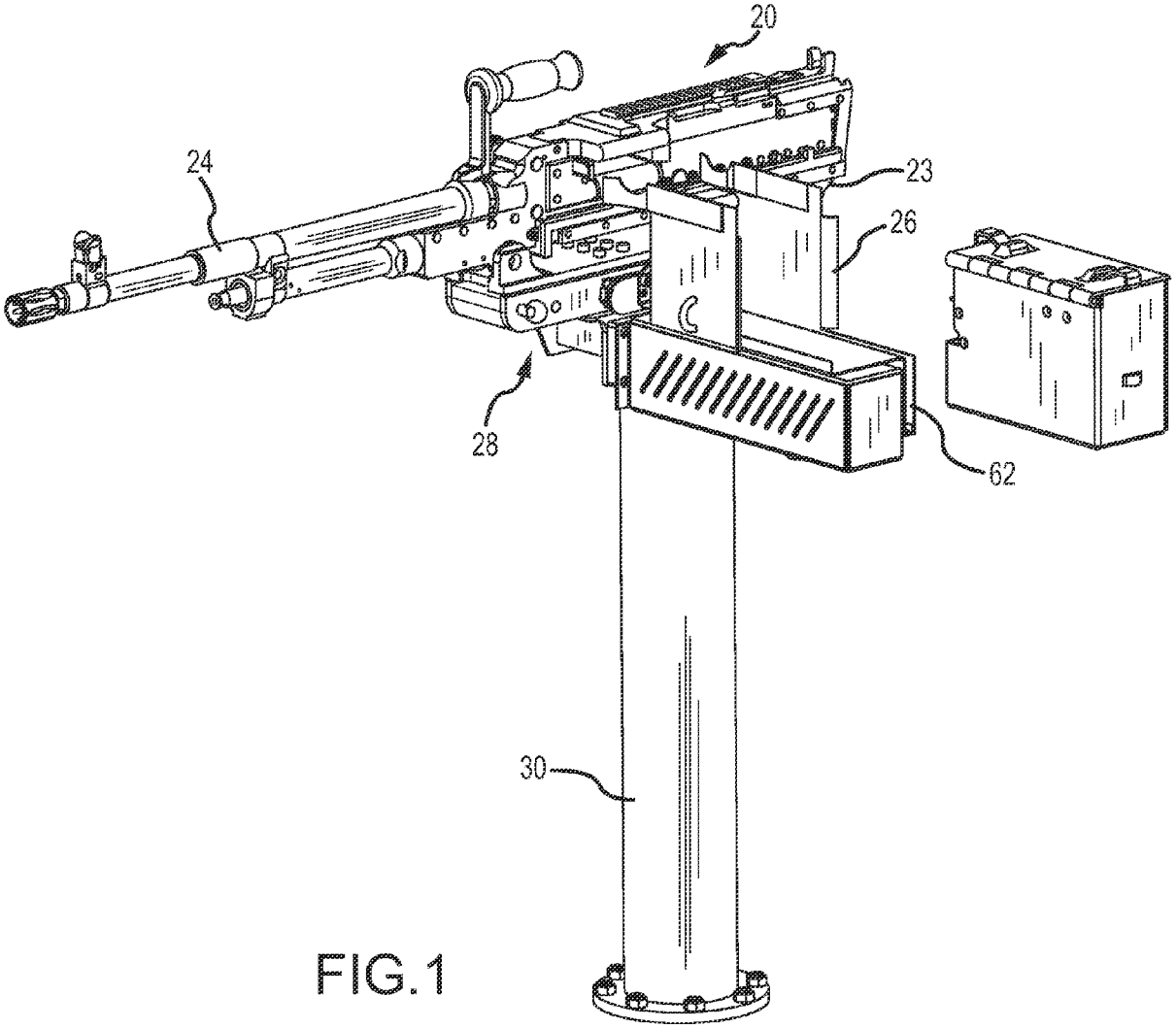
FIG. 1 is a generalized perspective view of one type of an exemplary imitation machine gun which incorporates and embodies a recoil simulator and method according to the present invention.

One type of an exemplary imitation machine gun 20 which is used in simulated weapons training activities, and which incorporates the present invention, is shown in FIG. 1. The machine gun 20 duplicates the look and feel and the mechanical features of an actual machine gun. The machine gun 20 includes a recoil simulator 22 (FIGS. 2-4), which causes the imitation machine gun 20 to emulate the impact of the recoil created by firing the actual machine gun.

The recoil simulator 22 has the effect of shaking or reciprocating the machine gun 20 in a forward and backward motion to simulate the recoil. The operator of the machine gun 20 senses the recoil in a handle 23 which includes a trigger 25. Depressing the trigger 25 causes the recoil simulator 22 to operate, thereby simulating the recoil impacts created when depressing the trigger of an actual machine gun and firing actual rounds. The forward and backward reciprocating motion occurs longitudinally parallel to the direction of extension of a barrel 24 of the gun 20. The recoil simulator 22 is concealed below a conventional ammunition box support tray 26, which extends transversely from the side of the gun 20, and below a split cradle assembly 28 which mounts the gun 20 to a support pedestal 30. The support pedestal 30 is attached to a floor or other support structure which emulates the actual environment in which the actual machine gun will be used, for example an opening in the side of a helicopter fuselage.

Figure 2:
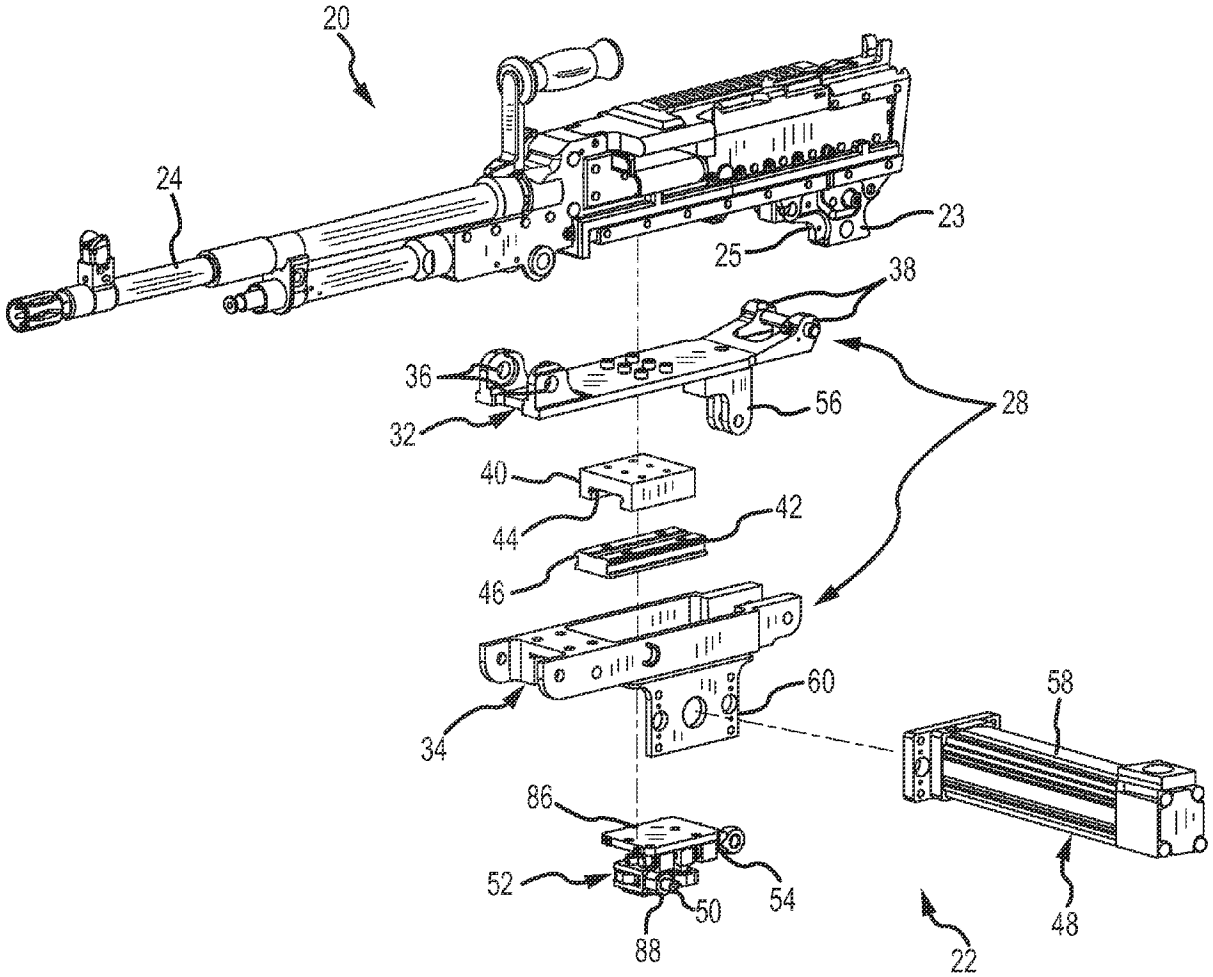
FIG. 2 is a partial exploded view of the imitation machine gun and the recoil simulator shown in FIG. 1.
Figure 3:
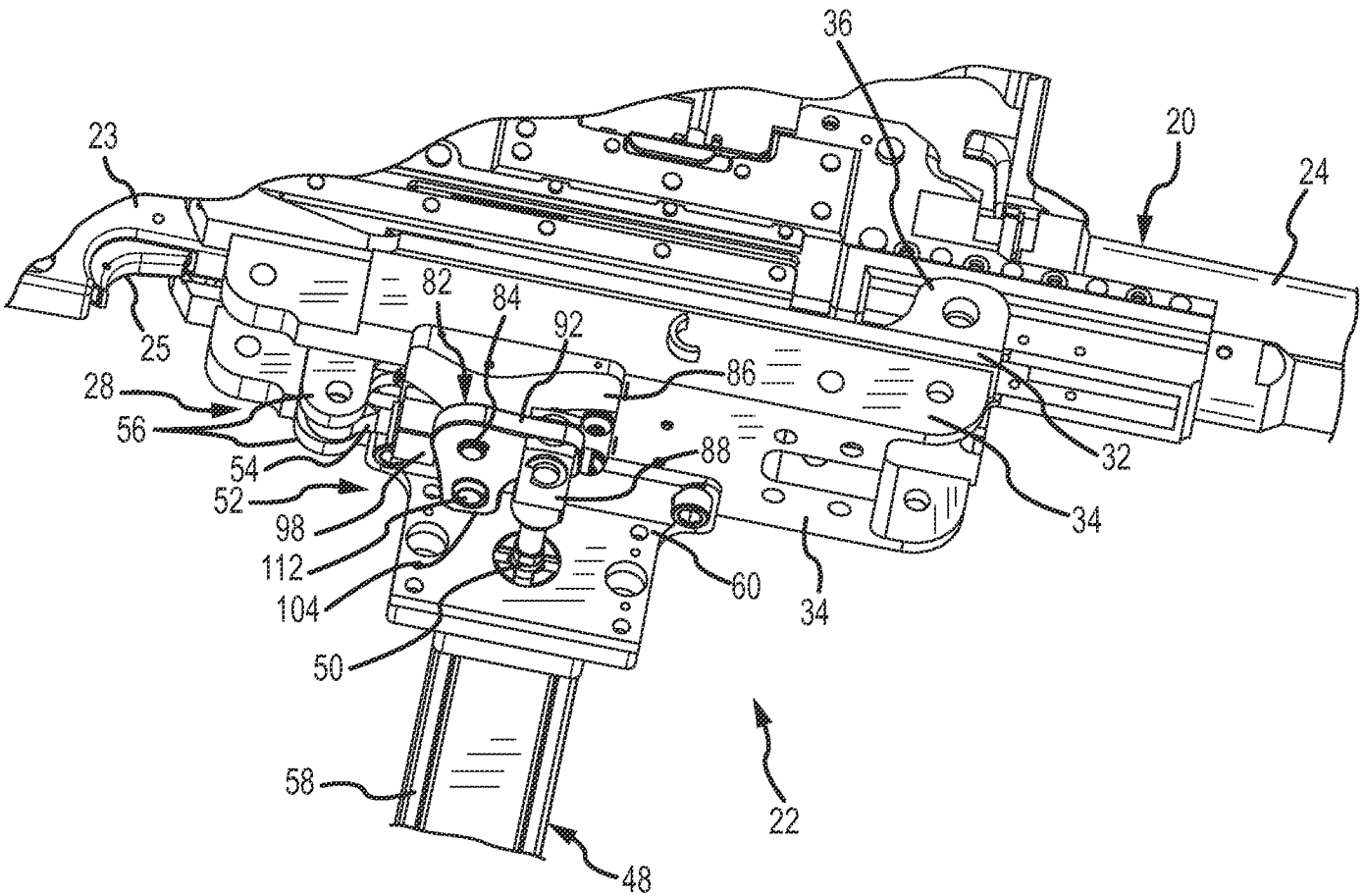
FIG. 3 is a partial bottom perspective view of the imitation machine gun shown in FIGS. 1 and 2, taken from the perspective of the opposite side of the gun from that shown in FIGS. 1 and 2, illustrating a split cradle assembly, a linear actuator and a drive angle change mechanism of the recoil simulator shown in a maximum forward position during a simulated recoil.
Figure 4:
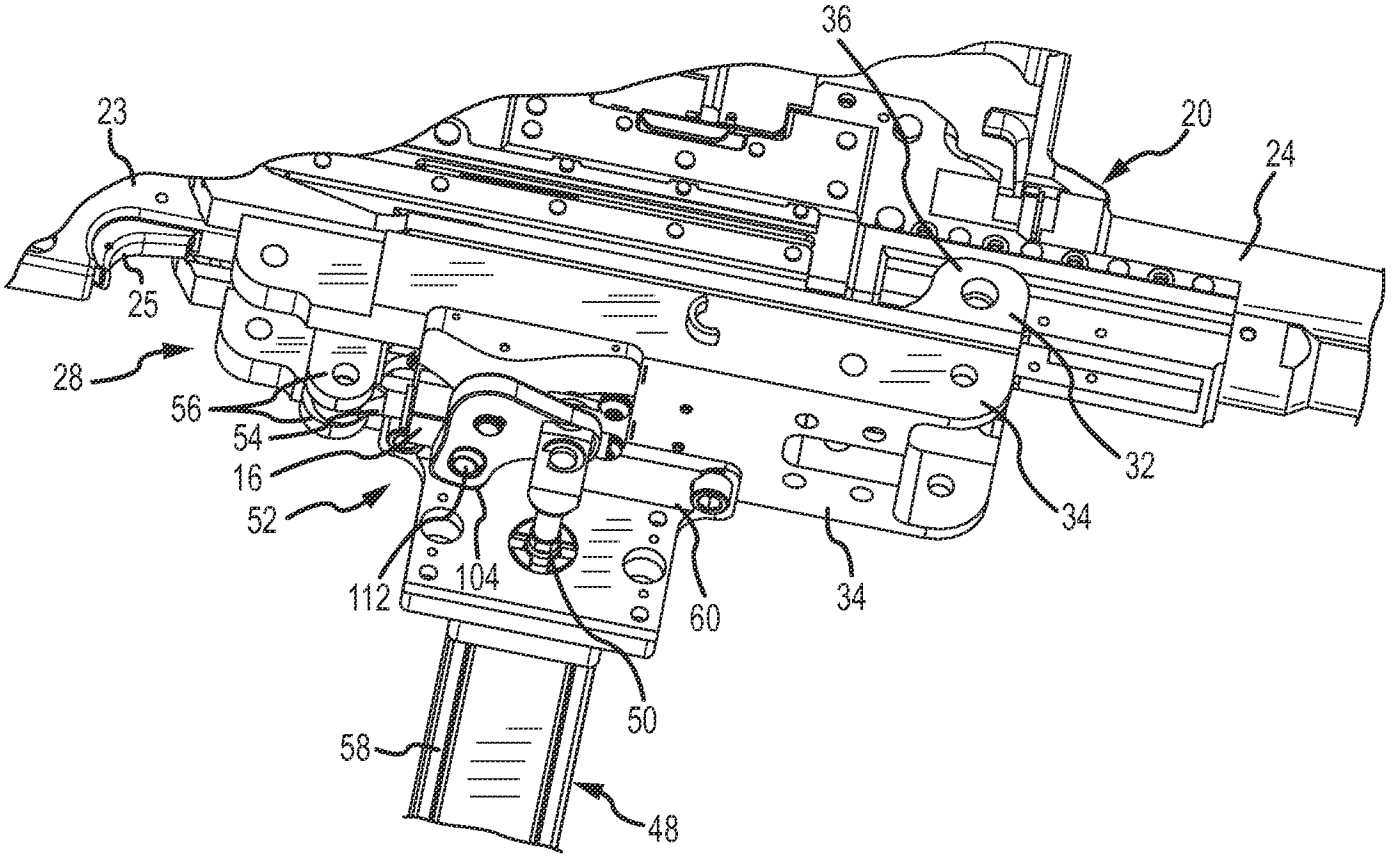
FIG. 4 is a view similar to FIG. 3, which illustrates positions of the split cradle assembly, the linear actuator and the drive angle change mechanism shown in a maximum rearward position during a simulated recoil.

The split cradle assembly 28 is formed by an upper movable cradle piece 32 and a separate lower stationary cradle piece 34, as shown in FIGS. 2-4. The gun 20 is rigidly attached to the movable piece 32. The stationary piece 34 is rigidly attached to the pedestal 30 (FIG. 1). The upper cradle piece 32 moves relative to the lower cradle piece 34. The recoil simulator 22 operatively connects the movable and stationary pieces 32 and 34 and reciprocates the movable piece 32 and the connected gun 20 relative to the stationary piece 34 and the pedestal 30, thereby simulating recoil associated with firing an actual machine gun. An actual machine gun is supported by a integral cradle assembly formed as a single unitary piece, and that single unitary piece does not include the movable and stationary pieces 32 and 34. Splitting the cradle assembly 28 into the movable and stationary pieces 32 and 34 allows the recoil simulator 22 to physically simulate the recoil of the actual machine gun.

The position of the gun 20 and the movable cradle piece 32 relative to the stationary cradle piece 34 at a point of maximum forward movement during a simulated recoil, as shown in FIG. 3, locates the movable piece 32 at a forward position relative to the stationary piece 34. When the gun 20 is fired, the recoil simulator 22 simulates the recoil by moving the movable piece 32 rearward relative to the stationary piece 34. The position of the gun 20 and the movable piece 32 relative to the stationary piece 34 at the rearwardmost position during the simulated recoil is illustrated in FIG. 4.

The movable and stationary cradle pieces 32 and 34 of the split cradle assembly 28 are shown in greater detail in FIG. 2. The movable cradle piece 32 includes front and back brackets 36 and 38, respectively, which attach to the housing of the machine gun 20 by pins to connect the imitation machine gun to the cradle assembly 28 in the same manner that an actual machine gun is connected to its integral cradle assembly. The stationary cradle piece 34 attaches to the pedestal 30 (FIG. 1) in a conventional manner. A bearing block 40 is attached to the bottom of the movable cradle piece 32, and a rail structure 42 is attached to the stationary cradle piece 34. The bearing block 40 includes grooves 44 which receive rails 46 of the rail structure 42. The bearing block 40 movably supports the movable cradle piece 32 and the gun 20 from the rail structure 42. The simulated recoil, is accomplished by moving the upper movable cradle piece 32 and its attached bearing block 40 relative to the lower stationary cradle piece 34 and its attached rail structure 42 while the grooves 44 and rails 46 fit together. The meshed relationship of the grooves 44 and the rails 46 causes the longitudinal reciprocation movement to occur parallel to the barrel 24 of the gun 20 and to the longitudinal axis of the gun 20.

The source of motive force for the recoil simulator 22 is a linear actuator 48. The linear actuator 48 creates linear reciprocating motion of an output shaft 50 (FIGS. 2-5). The output shaft 50 extends from the linear actuator 48 in the direction transverse to the longitudinal axis of the gun 20. A drive angle change mechanism 52 converts the transverse linear reciprocating movement of the output shaft 50 into longitudinal linear reciprocating movement of a drive shaft 54 (FIGS. 2-4 and 6-9). The linear motion of the drive shaft 54 is parallel to the longitudinal axis of the gun 20. The drive angle change mechanism 52 is connected to the bottom of the stationary cradle piece 34. The drive shaft 54 connects to a connection bracket 56 extending from the movable cradle piece 32. In this manner, the longitudinal linear reciprocating movement of the drive shaft 54 moves the movable cradle piece 32 and the attached gun 20 in a longitudinal reciprocating manner which simulates recoil.

The transversely extending linear actuator 48 is concealed substantially behind a wall plate 62 of the ammunition box support tray 26 (FIG. 1). The drive angle change mechanism 52 is concealed below the stationary piece 34 of the split cradle assembly 28. Mounting the linear actuator 48 and the drive angle change mechanism 52 below and behind the ammunition box support tray 26 and the wall plate 62 and below the stationary cradle piece does not change the shape or configuration of the imitation machine gun 20 relative to the actual machine gun which it imitates. Also, mounting the linear actuator 48 and the drive angle change mechanism 52 below and behind the ammunition box support tray 26 and wall plate 62 does not adversely influence the training required to replace the ammunition box during training when all of the simulated ammunition rounds have been used. Moreover, mounting the linear actuator 48 and the drive angle change mechanism 52 to the stationary cradle piece 34, and using the movable and stationary cradle pieces 32 and 34 instead of a unitary cradle assembly, does not change the feel of manipulating and operating the imitation machine gun 20 compared to the actual machine gun.

Figure 5:
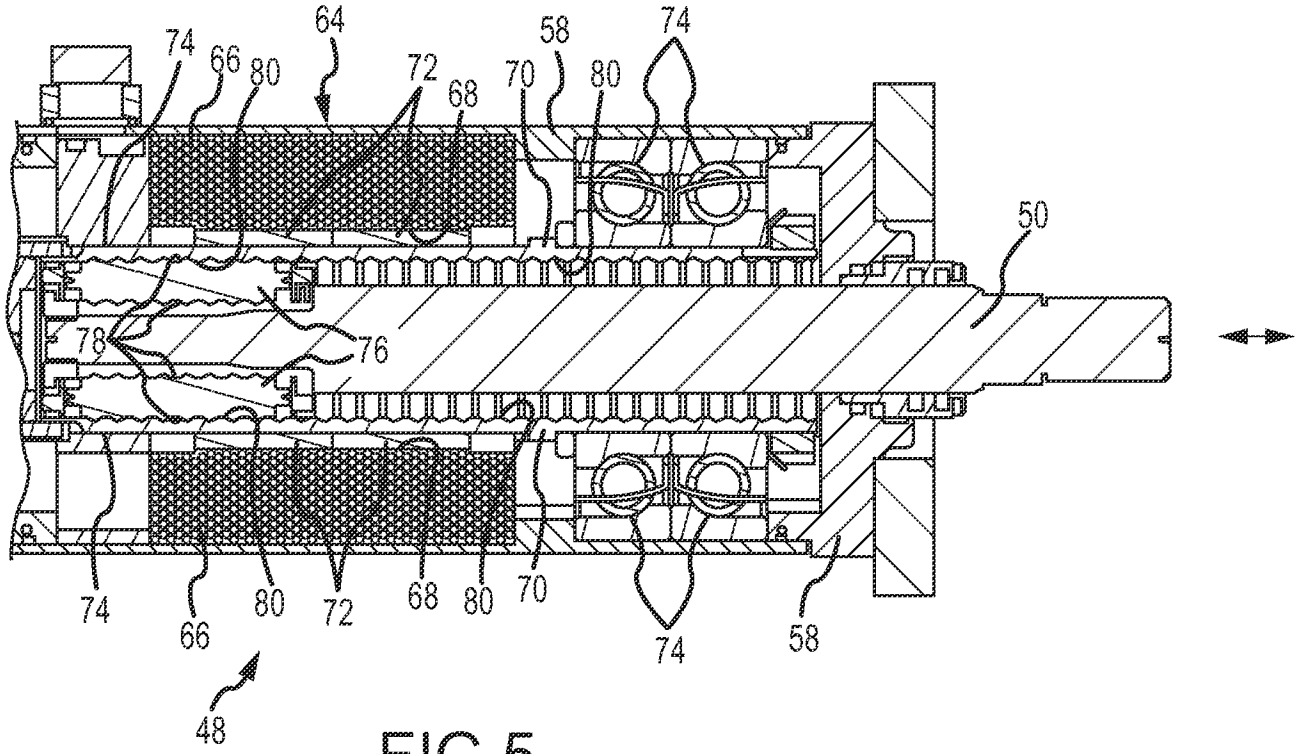
FIG. 5 is a generalized vertical section view through the linear actuator shown in FIGS. 2-4.
Figure 6:
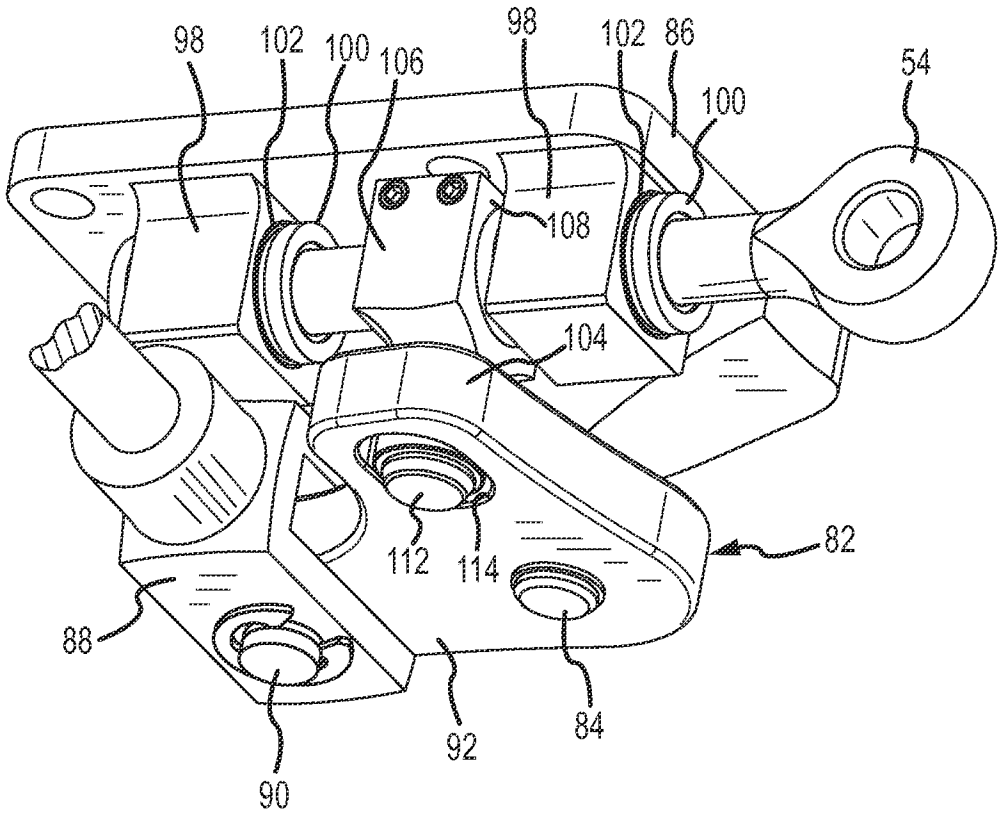
FIG. 6 is a perspective view of the drive angle change mechanism shown in FIGS. 2-4.
Figure 7:
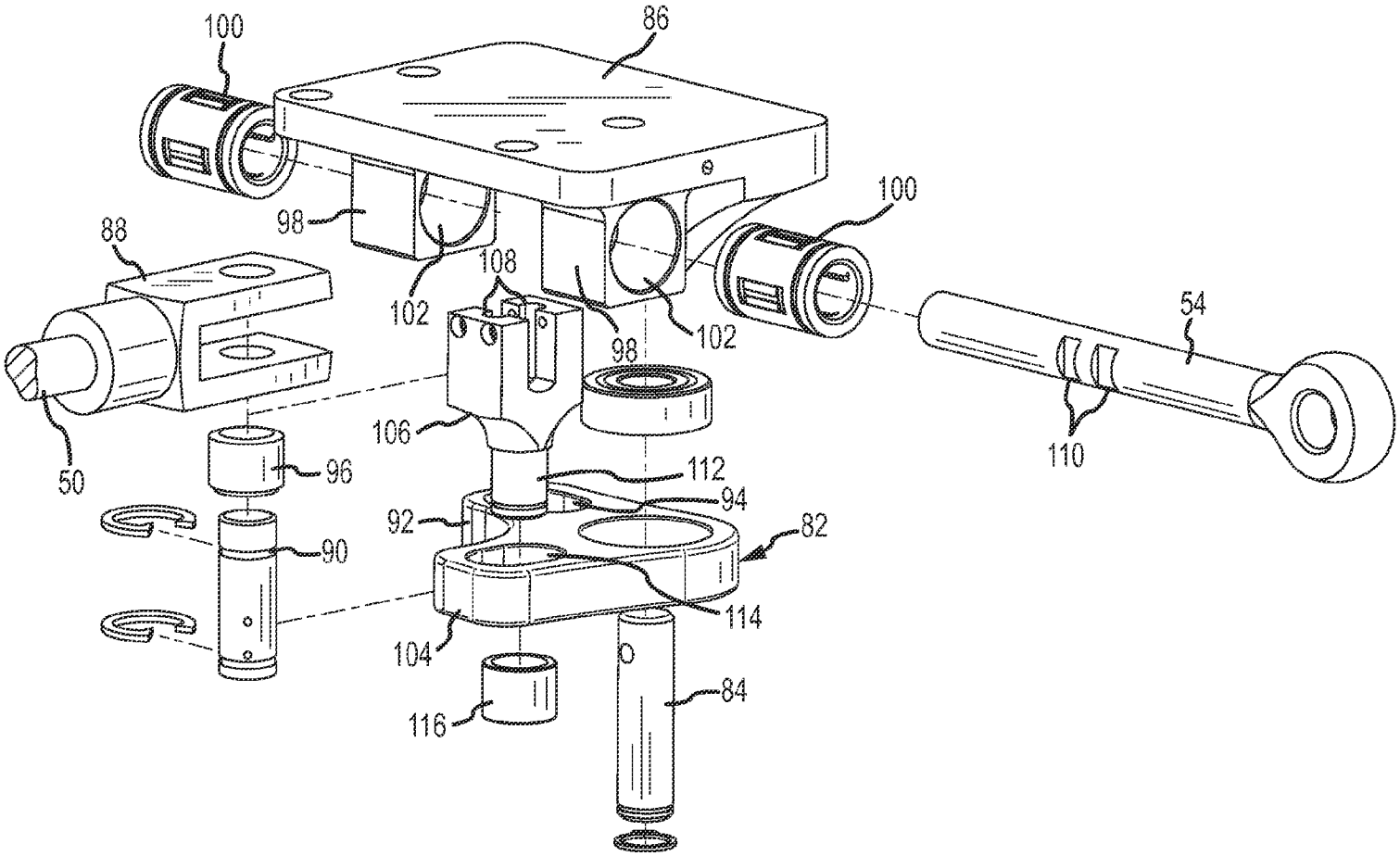
FIG. 7 is an exploded perspective view of the components of the drive angle change mechanism shown in FIG. 6.

More details of the linear actuator 48 of the recoil simulator 22 are shown in FIG. 5. The linear actuator 48 includes an outer rectangularly shaped housing 58 from which the output shaft 50 extends and moves in the linear reciprocating transverse motion. The housing 58 is connected through a bracket 60 (FIGS. 2-4) to the stationary cradle piece 34. An electric motor 64 is contained within the housing 58, and the electric motor 64 provides the motive force for reciprocating the output shaft 50 in linear movement.

The electric motor 64 includes annularly shaped field winding 66 which is rigidly attached within the housing 58. The field winding 66 conducts electric current waveforms or signals supplied by conductors extending through the housing 58 and produces a rotating magnetic field around a center opening 68 of the field winding 66. A hollow cylinder 70 is positioned for rotational movement within the center opening 68 of the field winding 66. A plurality of permanent magnets 72 are rigidly attached around the periphery of the cylinder 70 closely adjacent to the center opening 68 in the field winding 66. The permanent magnets 72 interact with the rotating magnetic field produced by the field winding 66, and cause the cylinder 70 to rotate within the center opening 68. Bearings and bushings 74 support the cylinder 70 for rotation within the housing 58.

A plurality of axially-oriented rollers 76 are connected around the exterior circumference of the shaft 50. The rollers 76 rotate around axes which are parallel to the axis of the shaft 50. The rollers 76 are restrained to prevent axial movement of the rollers relative to the shaft 50. The outside surfaces of the rollers 76 are threaded, and threads 78 of the rollers 76 mesh with threads 80 formed on the inside cylindrical surface of the hollow cylinder 70. As a result of this arrangement, the rotation of the cylinder 70 rotates the rollers 76 which has the effect of advancing the rollers 76 axially with respect to the axially stationary cylinder 70, thereby causing the rollers 76 and the attached shaft 50 to move linearly with respect to the housing 58 due to the meshed relationship of the threads 78 on the rollers 76 with the threads 80 on the inside surface of the hollow cylinder 70. Rotation of the cylinder 70 in one direction causes the output shaft 50 to extend, while rotation of the cylinder in the opposite direction causes the output shaft 50 to retract. The rate of rotation of the cylinder, in both directions, is directly correlated to the rate of extension and retraction of the output shaft 50.

The characteristics of the electrical current waveform conducted by the winding 66 establishes the rate at which the magnetic field rotates, and the rate of rotation of the magnetic field establishes the rate of rotation of the cylinder 70, which in turn determines the rate of linear movement of the output shaft 50. The characteristics of the electrical current waveform conducted by the winding 66 also control the direction that the cylinder 70 rotates, thereby establishing the direction of linear extension and retraction of the output shaft 50. Changing the electrical current characteristics of the waveform applied to the winding 66 changes the direction of rotation of the cylinder 70 and achieves reciprocating movement of the output shaft 50. The amount of the electrical current conducted by the winding 66 establishes the strength or magnitude of the magnetic field, and the strength of the magnetic field establishes the amount of amount of linear force applied by the output shaft 50. Changes in the amount of electrical current conducted during the course of a single longitudinal stroke of the output shaft 50 allows the profile of force applied over the course of that stroke to be varied.

Thus, in the manner described, the rate and direction of linear advancement of the output shaft 50, and the amount of force applied from the output shaft 50 over the course of each extension and retraction stroke, are directly and readily controlled by characteristics of the waveform of electrical current conducted by the winding 66. Controlling the characteristics of the electrical current conducted by the winding 66 is straightforwardly accomplished, allowing the physical effects of an recoil of an actual machine gun to be simulated by the characteristics of the electrical current waveform applied to the linear actuator 48. The amount of force of the recoil, the frequency of the impacts of each recoil, and other effects are realistically simulated in this same manner. A servo drive supplies the electrical current waveform to the linear actuator 52 through electrical conductors which are concealed within the housing of the imitation machine gun 20. The servo drive is controlled by the computer systems which are used in the simulated weapons training program. No external components are added, and the external configuration of the imitation machine gun is not changed from the external configuration of the actual machine gun. Consequently, the person undergoing training does not become accustomed to or rely on characteristics which are not present on the actual machine gun.

Using the linear actuator 48 in the recoil simulator 22 offers benefits over hydraulic and pneumatic devices which create linear movement. The electrically actuated linear actuator 48 offers lower operational costs, compared to the operating costs of pumps and other auxiliary equipment which are necessary to operate hydraulic and pneumatic devices sometimes used in previous recoil simulators. The linear actuator 48 has a smaller size and is more easily integrated into the imitation machine gun 20 than the cylinders and fluid conductors required for hydraulic and pneumatic devices. The output force available from the linear actuator 48 equals or exceeds that from hydraulic and pneumatic devices. The speed at which the output shaft 50 is capable of moving is greater than typical hydraulic and pneumatic devices. The speed and force from the output shaft may be varied during the course of a single stroke of motion to enhance the simulated effects, and such a variability is difficult or impossible to achieve using hydraulic and pneumatic devices. Furthermore, many control characteristics are attainable by straightforward programming and circuit design in simulated weapon training systems. An example of a satisfactory linear actuator for use in the recoil simulators described herein is a model GSX linear actuator manufactured by Exlar of Chanhassen, Minn. 55317 USA. An example of a satisfactory servo drive for the linear actuator is a model Cornet servo drive manufactured by Elmo Motion Control of Nashua, N.H. 03060 USA.

More details of the drive angle change mechanism 52 are shown in FIGS. 6-9. A bell crank 82 converts the transverse linear motion of the output shaft 50 to the longitudinal linear motion of the drive shaft 54. The bell crank 82 is connected by and pivots about a pin 84 to a base plate 86. The base plate 86 is rigidly attached by screws to the lower stationary cradle piece 34 (FIGS. 3 and 4).

A clevis 88 is connected to the end of the output shaft 50 from the linear actuator. A pin 90 pivotally connects the clevis to one arm 92 of the bell crank 82. The pin 90 extends through an elongated opening 94 in the arm 92 of the bell crank, and a bushing 96 surrounds the pin 90 where it extends through the opening 94. The opening 94 is elongated to accommodate linear movement of the output shaft 50 relative to the arcuate pivoting or rotational movement of the arm 92 of the bell crank 82 at the opening 94, when the bell crank pivots.

The drive shaft 54 is supported from the baseplate 86 by two bearing blocks 98. Bushings 100 are positioned in openings 102 in the bearing blocks 98, and the drive shaft 54 extends through the bushings 100. In this manner, the drive shaft 54 is supported for longitudinal movement by the base plate 86.

Another arm 104 of the bell crank 82 is pivotally connected to the drive shaft 54 by a pivot fork 106. A bifurcated end 108 of the pivot fork 106 connects to flat surfaces 110 formed on opposite sides of the drive shaft 54. The distance between the flat surfaces 110 on the drive shaft 54 and the distance between the mating portions of the bifurcated end 108 of the pivot fork 106 are approximately equal, to allow the bifurcated end 108 to fit closely adjacent to the flat surfaces 110. Set screws (not shown) rigidly hold the bifurcated end 108 to the flat surfaces 110 of the drive shaft 54, thereby rigidly connecting the pivot fork 106 to the drive shaft. As a result of this connection, the pivot fork 106 is rigidly connected to move linearly with the linear movement of the drive shaft 54.

A pivot post 112 extends from the pivot fork 106 through an elongated opening 114 in the arm 104 of the bell crank, and a bushing 116 surrounds the pivot post 108 where it extends through the opening 114. The opening 114 is elongated to accommodate linear movement of the pivot fork 106 relative to the arcuate pivoting or rotational movement of the arm 104 of the bell crank 82, when the bell crank pivots.

Figure 8:
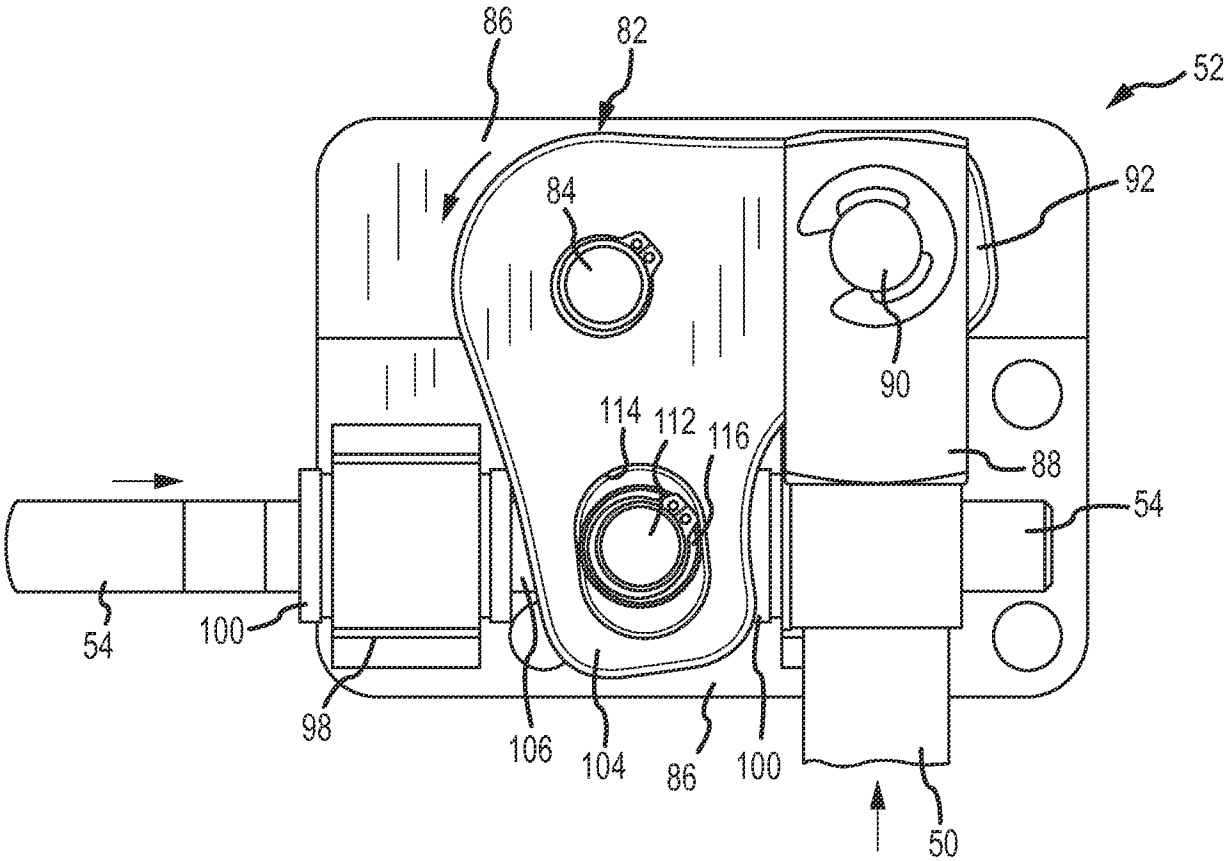
FIG. 8 is a plan view of the drive angle change mechanism shown in FIG. 6, illustrating the position of components shown in FIG. 3 in the maximum forward position during a simulated recoil.

When the output shaft 50 of the linear actuator 48 is extended as shown in FIG. 8, the bell crank 82 pivots counterclockwise (as shown). The upward (as shown) force from the clevis 88 attached to the end of the output shaft 50 causes the bell crank arm 92 to move upward and create counterclockwise pivoting movement of the bell crank 82. The other arm 104 of the bell crank 82 moves to the right with counterclockwise pivoting motion (as shown), thereby forcing the pivot fork 106 and the attached drive shaft 54 to move in retraction to the right (as shown) toward the drive angle change mechanism 52. The retraction movement of the drive shaft 54 is coupled to the upper movable cradle piece 32 of the split cradle assembly 28, causing the cradle piece 32 to move to the forward position which simulates the maximum forward location of the gun 20 during the simulated recoil (FIG. 3).

Figure 9:
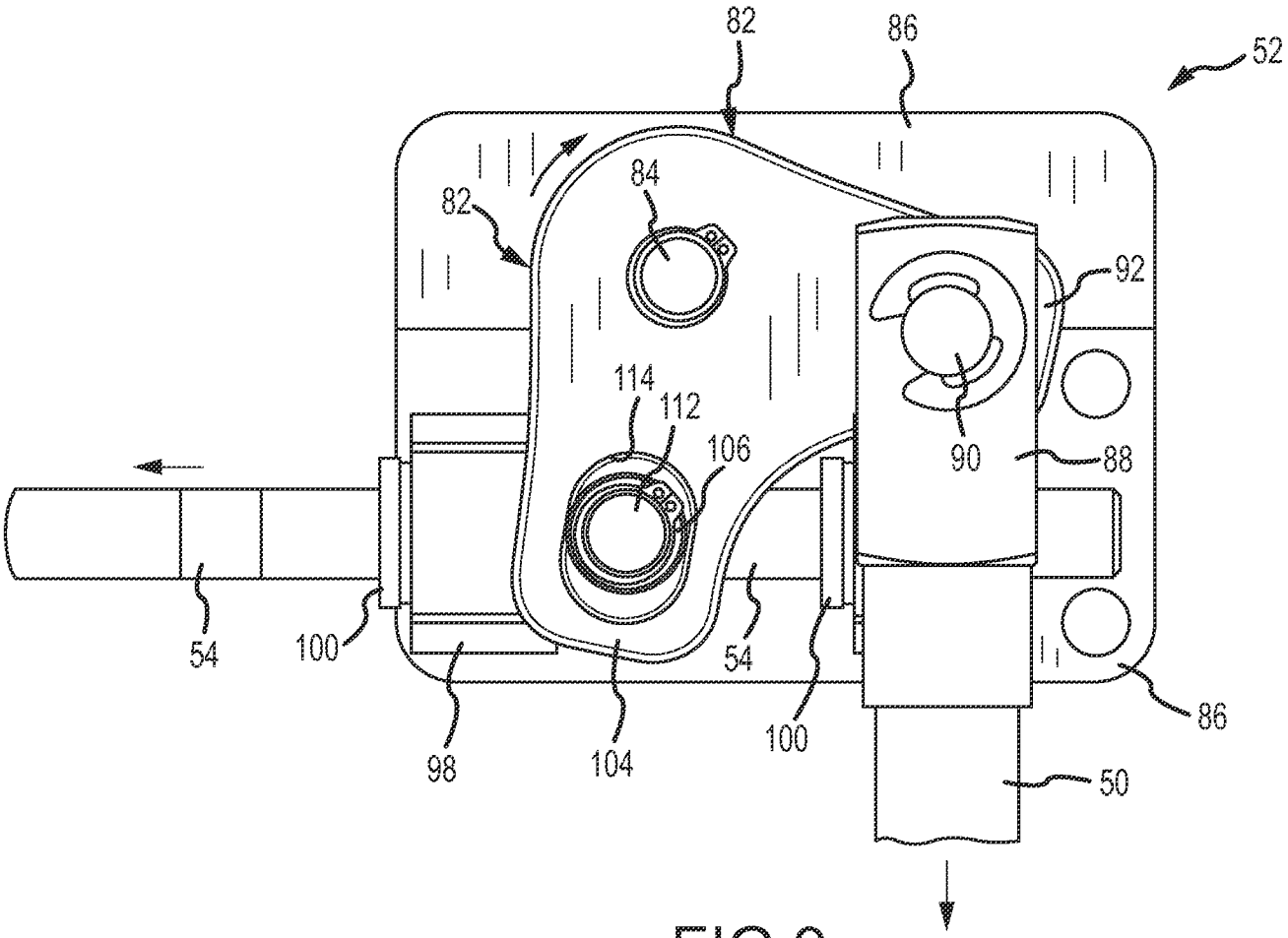
FIG. 9 is a view similar to FIG. 8, illustrating the position of components shown in FIG. 4 in the maximum rearward position during a simulated recoil.
Figure 10:
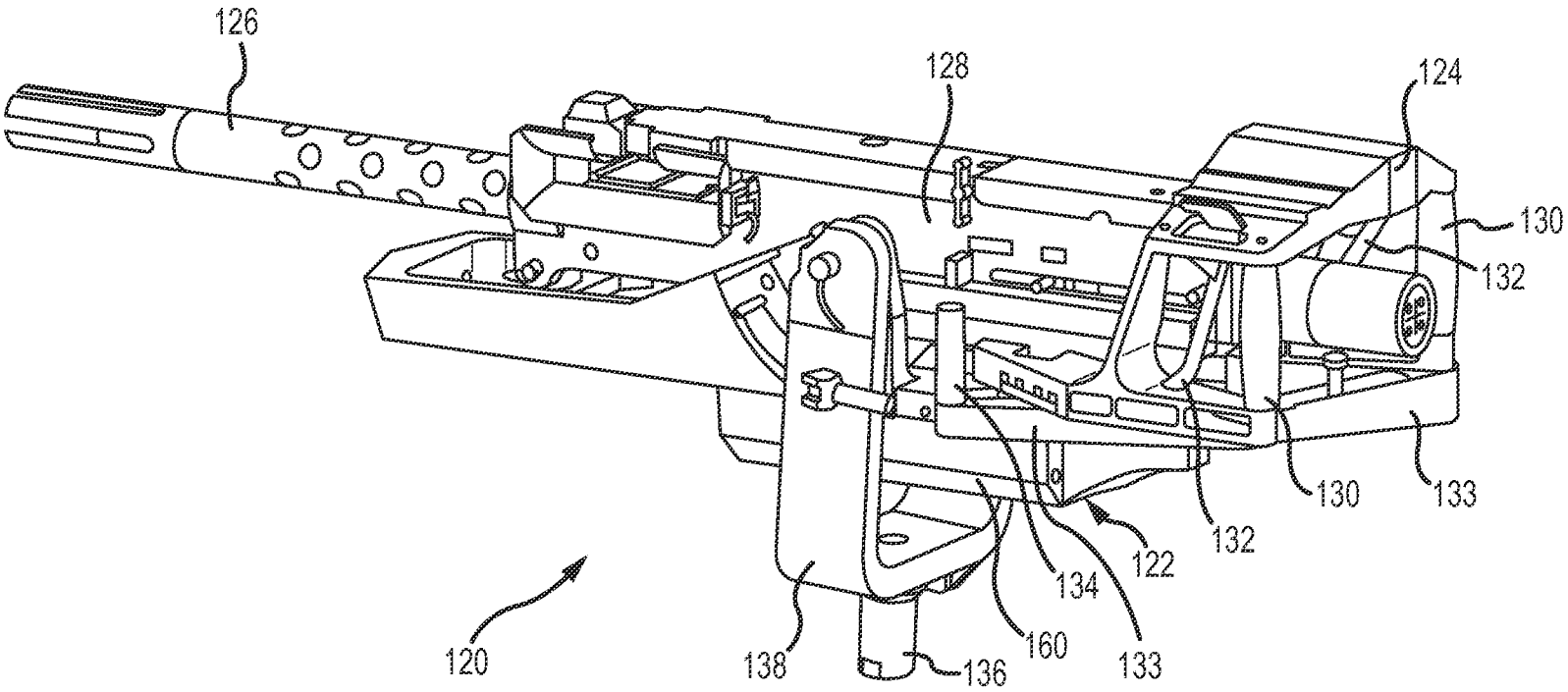
FIG. 10 is a generalized perspective view of another type of exemplary imitation machine gun which incorporates and embodies a recoil simulator and method according to the present invention.

When the output shaft 50 of the linear actuator 48 is retracted as shown in FIG. 9, the bell crank 82 pivots clockwise (as shown). The downward (as shown) force from the clevis 88 attached to the end of the output shaft 50 causes the bell crank arm 92 to move downward with clockwise pivoting motion (as shown). The other arm 104 of the bell crank 82 moves to the left with clockwise pivoting motion (as shown), thereby forcing the pivot fork 106 and the attached drive shaft 54 to move to the left (as shown) and thereby extend from the drive angle change mechanism 52. The extension movement of the drive shaft 54 is coupled to the upper movable cradle piece 32 of the split cradle assembly 28, causing the cradle piece 32 to move to the rearward position which simulates the location of the gun 20 at the maximum rearward position during the simulated recoil (FIG. 4).

The present invention is also embodied in another type of an exemplary imitation machine gun 120, shown in FIGS. 10-13, which is used in simulated weapons training activities. The machine gun 120 duplicates the look and feel and the mechanical features of a different type of actual machine gun than those simulated by the imitation machine gun 20 (FIGS. 1-4). The imitation machine gun 120 includes a recoil simulator 122 (FIGS. 11-13), which causes a handle and trigger assembly 124 to reciprocate forward and backward relative to a barrel 126 and a housing 128 of the imitation machine gun 120, and thereby simulate the recoil of firing ammunition rounds from an actual machine gun. The reciprocating movement of the handle and trigger assembly 124 emulates the impact of the recoil, and that impact is felt by the operator when gripping handles 130 of the handle and trigger assembly 124 and operating the machine gun 120.

The recoil simulator 122 moves only the trigger and handle assembly 124 of the imitation machine gun 20 in the forward and backward motion to simulate the recoil. The remaining parts of the gun 120, including the barrel 126 and the housing 128, remain stationary during recoil simulation. A trigger 132 is pivotally connected to the assembly 124 in front of the handles 130. The trigger 132 is depressed by the operator to initiate the operation of the recoil simulator 22 to simulate firing an actual machine gun.

An arming lever 133 with a handle 134 is pivotally connected below the handle and trigger assembly 124. The operator grasps the handle 134 and pulls the arming lever 133 rearwardly relative to the handle and trigger assembly 124 to simulate the action of charging the bolt in an actual machine gun. Charging the bolt readies an actual machine gun to fire ammunition rounds. Similarly, pulling the arming lever 133 readies the imitation machine gun to fire simulated rounds, once the operator depresses the trigger 132. The arming lever 133 and its handle 134 are attached to the handle and trigger assembly 124 in the same position as on an actual machine gun. The recoil simulator 122 is located below the housing 128 at the rear the gun 120. Located in this manner, the recoil simulator 122 is substantially concealed from view of the user. Positioning the recoil simulator 122 in this manner does not substantially change the feel of the gun 120 relative to the way that an actual machine gun feels when operated.

A support pedestal 136 is attached to a floor or other support structure which emulates the actual environment in which the actual machine gun will be used, for example an opening in the side of a helicopter fuselage. The upper end of the support pedestal 136 is formed as a fork-shaped support structure 138. The housing 128 of the machine gun 120 is connected to the support structure 138 by two connection pins, one of which is shown at 140 (FIG. 13). The connection pin 140 extends through a bracket 141 (FIG. 12) in the lower portion of the housing 128 and connects the imitation machine gun 120 in the same manner that an actual machine gun is connected to a support pedestal. A similar pin (not shown) connects the front lower portion of the housing 128 to the front (not shown) of the fork support structure 138, in a manner similar to that shown above (FIGS. 1-4) in connection with the machine gun 20. Consequently, the housing 128 and all of the other components of the imitation machine gun 120, except the handle and trigger assembly 124, remain stationarily positioned while the recoil simulator 122 reciprocates the handle and trigger assembly 124 to simulate recoil.

Figure 11:
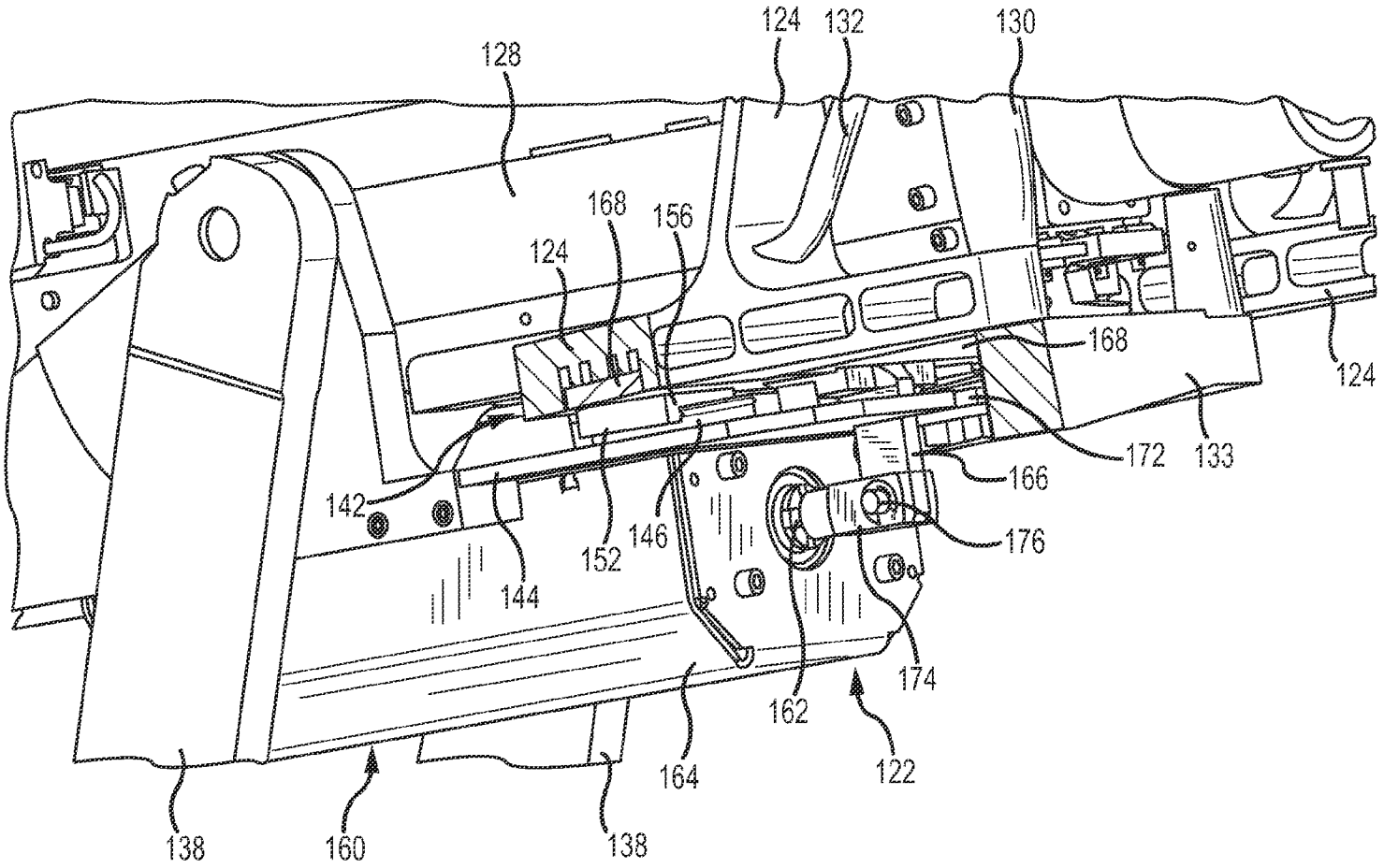
FIG. 11 is a partial rear perspective view of the imitation machine gun and the recoil simulator shown in FIG. 10, with a portion cut away.
Figure 12:
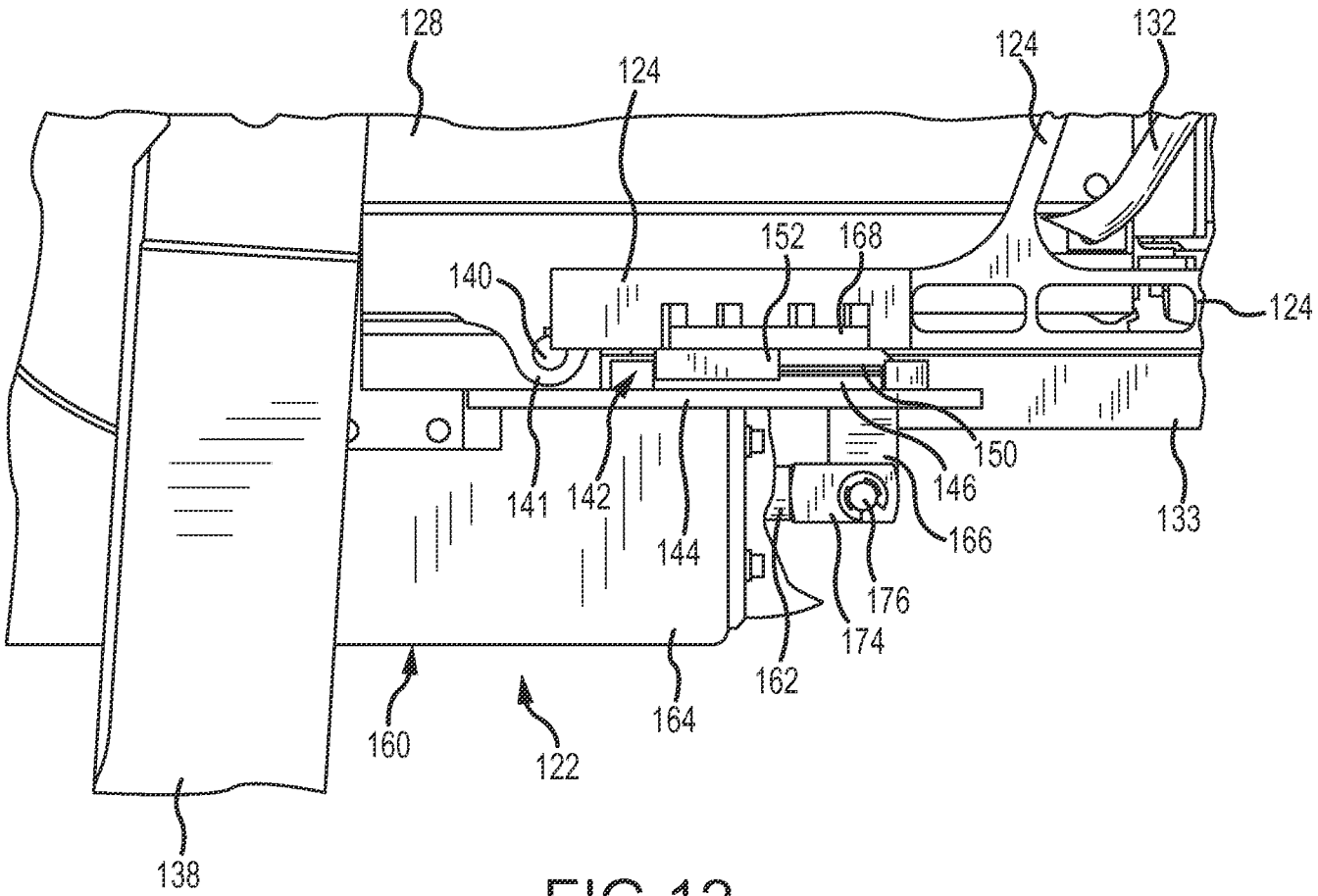
FIG. 12 is a partial side elevational view of the imitation machine gun and the recoil simulator shown in FIG. 11.
Figure 13:
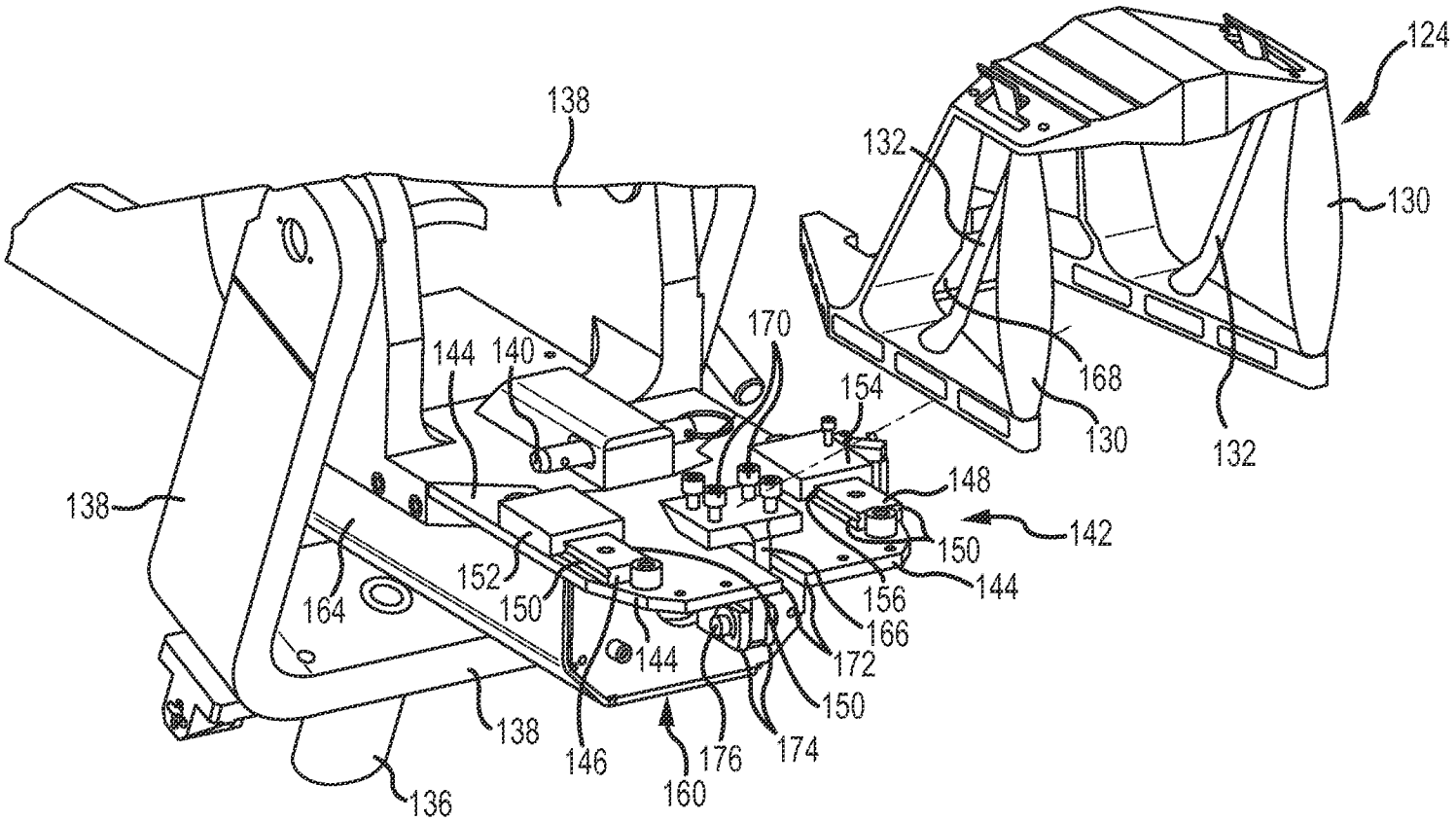
FIG. 13 is an perspective view of the recoil simulator shown in FIGS. 10-12 with components of the imitation machine gun shown in an exploded relationship.

A split cradle assembly 142 connects the handle and trigger assembly 124 to the housing 128 to accommodate the reciprocating movement which simulates the recoil, as shown in FIGS. 11-13. The split cradle assembly 142 is formed by a lower relatively stationary cradle piece 144 and by a separate relatively movable upper cradle piece. As shown in FIG. 13, the lower stationary cradle piece 144 includes rail structures 146 and 148 which are attached on opposite sides of the cradle piece 144. The rail structures 146 and 148 extend in a parallel relationship with one another, with the barrel 126, and with a longitudinal axis of the gun 120. Each rail structure 146 and 148 includes two rails 150 which project outward from the opposite longitudinally extending sides of each rail structure 146. The lower stationary cradle piece 144 is connected stationarily relative to the fork support structure 138.

The separate relatively movable upper cradle piece comprises bearing blocks 152 and 154 which are connected to the handle and trigger assembly 124, as understood from FIG. 13. The bearing blocks 152 and 154 are attached to the assembly 124 to extend in a parallel relationship with one another and to contact and ride along the parallel rail structures 146 and 148 connected to the lower stationary cradle piece 144. Grooves 156 extend longitudinally along opposite internal sides of each bearing block 152 and 154. The rails 150 fit within the grooves 156 and thereby mesh the bearing blocks 152 and 154 with the rail structures 146 and 148, respectively.

The reciprocating movement of the handle and trigger assembly 124 occurs with the bearing blocks 150 and 152 contacting the rail structures 146 and 148 and with the rails 156 meshing with the grooves 154. The inter-fitting or meshed relationship of the grooves 156 and the rails 150 confines the reciprocating movement of the handle and trigger assembly 124 to a direction parallel to the extension of the barrel 126 and the longitudinal axis of the gun 120, and prevents the handle and trigger assembly 124 from moving vertically relative to the lower stationary cradle piece 144 and the housing 128 of the gun 120.

The recoil simulator 122 operatively connects the movable and stationary cradle pieces to reciprocate the handle and trigger assembly 124 relative to the gun 120. With each round of simulated ammunition stimulatively fired by the gun 120, the recoil simulator 122 rapidly moves the handle and trigger assembly 124 rearward, followed immediately by retracting the handle and trigger assembly 124 forward to the original position. This backward and forward movement of the handle and trigger assembly 124 relative to the housing 128 is understood from FIG. 12.

The source of motive force for the recoil simulator 122 is a linear actuator 160. The linear actuator 160 has substantially the same characteristics as the linear actuator 48 (FIG. 5) previously described, and is driven similarly by a servo drive. The linear actuator 160 creates linear reciprocating motion of an output shaft 162 (FIGS. 11-13). A housing 164 of the linear actuator 160 is attached to and below the lower stationary cradle piece 144 and the fork support structure 138, to orient the output shaft 162 for extension and retraction in a direction parallel to the longitudinal axis of the gun 120. Control of the electrical current waveform characteristics applied to the linear actuator 160 controls the direction, rate and other movement characteristics of the output shaft 162, as previously described.

A connection bracket 166 is rigidly connected to and extends downward from the handle and trigger assembly 124. The connection bracket 166 is attached to a transverse plate 168 which extends across the front bottom of the handle and trigger assembly 124. Bolts 170 (FIG. 13) connect the connection bracket 166 to the transverse plate 168. When connected to the handle and trigger assembly 124, the connection bracket 166 extends through a slot 172 formed in the lower relatively stationary cradle piece 144. The slot 172 has sufficient width and length to permit free reciprocating movement of the connection bracket 166 relative to the stationary cradle piece 144 during the reciprocating movement of the handle and trigger assembly 124.

A clevis 174 is attached to the distal end of the output shaft 162. The clevis 174 is connected by a pin 176 to the connection bracket 166. When the output shaft 166 of the linear actuator 160 is extended, the accompanying rearward movement of the connection bracket 166 moves the handle and trigger assembly 124 rearwardly. Similarly, when the output shaft 166 is retracted, the handle and trigger assembly 124 is moved forwardly.

The longitudinally extending linear actuator 160 is substantially concealed beneath the lower stationary cradle piece 144 and the housing 128 in a location which does not interfere with manipulating the trigger 132 or manipulating the arming lever 133 and handle 134, or performing any other action necessary to operate the gun 120. Mounting the linear actuator 160 below the stationary cradle piece does not change the shape or configuration of the imitation machine gun 120. The electrical conductors (not shown) which conduct the electrical current waveform to the linear actuator 160 are concealed within the support pedestal 136 and the fork support structure 138. A cover (FIG. 10) encloses and conceals the output shaft 162, the connection bracket 166, and their relative connection with the clevis 174, without obstructing their movement and while shielding these components from inadvertent contact by the gun operator.

The effects from the recoil simulators 22 and 122 produce effective training with the imitation machine guns 20 and 120, thereby avoiding the expense and difficulties associated with training by use of an actual machine gun. The split cradle assemblies 28 and 142 allow shaking part or all of the imitation machine gun in a manner similar to the recoil of an actual machine gun. Use of the linear actuators 48 and 160 permits direct control over the force, frequency, force-position characteristics of the reciprocating movement. The computer systems of the simulated weapons training program control this reciprocating movement by controlling the characteristics of the electrical current waveform supplied to the linear actuators 48 and 160. The recoil simulators 22 and 122 are effectively concealed within the imitation machine guns 20 and 120 in a way which does not compromise faithful replication during training. The need for extra equipment, such as hydraulic and pneumatic hoses and cylinders that might adversely influence the training, and the ability to effectively use an actual machine gun, is avoided. The imitation machine gun achieves and maintains substantially the same functionality, performance and physical look and feel of the actual machine gun. The split cradle assemblies 28 and 142, the drive angle change mechanism 52, and the linear actuators 48 and 160, are reliably capable of repeated and heavy use without premature or unexpected failure. Other advantages and improvements will become apparent upon gaining a full appreciation of the present invention.

The detail of the above description constitutes a description of preferred examples of implementing the invention, and the detail of this description is not intended to limit the scope of the invention defined by the following claims, except to the extent explicitly incorporated in the claims.

The invention claimed is:

1. A recoil simulator for use in an imitation machine gun to simulate recoil of an actual machine gun, the imitation machine gun having a barrel, the recoil simulator comprising:

a split cradle assembly comprising a relatively movable cradle piece and a relatively stationary cradle piece, the stationary cradle piece adapted to be connected to a stationary support, the movable cradle piece adapted to be connected to at least a portion of the imitation machine gun, the movable cradle piece operatively connected to the stationary cradle piece to move with relative longitudinal reciprocating movement parallel to the barrel of the imitation machine gun; and a linear actuator comprising an output shaft which extends and retracts with linear motion, the linear actuator connected to the stationary cradle piece in an orientation which positions the output shaft transversely relative to the barrel of the imitation machine gun, the output shaft connected to the movable cradle piece to transfer the linear extension and retraction motion of the output shaft into the longitudinal reciprocating movement of the movable cradle piece and the portion of the imitation machine gun connected to the movable cradle piece; and a drive angle change mechanism connected to the stationary cradle piece, the drive angle change mechanism including a drive shaft which extends and retracts with linear motion parallel to the barrel of the imitation machine gun, the drive shaft connecting to the movable cradle piece, the drive angle change mechanism including a movable component which connects to the output shaft of the linear actuator and to the drive shaft, the movable component converting the transverse extension and retraction of the output shaft into the longitudinal extension and retraction of the drive shaft; and wherein:

the drive angle change mechanism converts the transverse linear movement of the output shaft into longitudinal linear movement of the drive shaft and the connected movable cradle piece to simulate the recoil of firing an actual machine gun.

2. A recoil simulator as defined in claim 1, wherein:

the movable component of the drive angle change mechanism comprises a bell crank.

3. A recoil simulator as defined in claim 2, wherein:

the bell crank includes opposite ends;

one end of the bell crank is connected to the drive shaft with a pivot fork, the pivot fork having a pivot post which is pivotally connected to one end of the bell crank, and the pivot fork includes a bifurcated end which is rigidly connected to the output shaft.

4. A recoil simulator as defined in claim 3, wherein:

the other end of the bell crank is connected to the drive shaft.

5. A recoil simulator as defined in claim 1, wherein the imitation machine gun includes an ammunition box support tray which extends transversely relative to the barrel of the imitation machine gun, and wherein:

the linear actuator is connected below the ammunition box support tray.

6. A recoil simulator as defined in claim 5, wherein:

the drive angle change mechanism is connected below the stationary cradle piece.

7. A recoil simulator as defined in claim 1, wherein:

the portion of the entire imitation machine gun which is connected to the movable cradle piece is the entire imitation machine gun.

8. A recoil simulator as defined in claim 1, wherein:

the portion of the entire imitation machine gun which is connected to the movable cradle piece is a handle and trigger assembly.

9. A recoil simulator as defined in claim 8, wherein:

the linear actuator is connected to the stationary cradle piece in an orientation which positions the output shaft to extend and retract longitudinally parallel to the barrel of the imitation machine gun; and the output shaft is connected to the movable cradle piece to reciprocate the handle and trigger assembly connected to the movable cradle piece longitudinally with extension and retraction of the output shaft.

10. A recoil simulator as defined in claim 9, wherein:

the longitudinal reciprocating motion of the handle and trigger assembly occurs with respect to the remaining portion of the imitation machine gun.

11. A recoil simulator as defined in claim 1, wherein:

the linear actuator includes an electric motor which extends and retracts the output shaft.

12. A recoil simulator as defined in claim 11, wherein:

the electric motor extends and retracts the output shaft in relation to characteristics of an electric current waveform applied to the motor; and the characteristics of the electrical current waveform control the direction, rate and force applied from the output shaft.

13. A recoil simulator as defined in claim 11, wherein the electric motor comprises:

an annular shaped winding which generates a rotating magnetic field in response to and having characteristics which relate to the characteristics of the electrical current waveform applied to the winding;

a rotationally supported cylinder extending through the annular winding, the cylinder including a center opening through which the output shaft extends, the cylinder including magnets which magnetically interact with the rotating magnetic field of the winding to rotate the cylinder by the magnetic interaction, the center opening having internal threads along the cylinder;

at least one elongated roller connected to the output shaft and which rotates about an axis which is parallel to the output shaft, each roller having exterior threads which mesh with the internal threads of the cylinder; and wherein:

rotation of the cylinder moves the internal threads of the cylinder and the exterior threads of the rotor to extend and retract the output shaft linearly.

14. A recoil simulator as defined in claim 1, wherein the connection of the movable cradle piece to the stationary cradle piece includes, a bearing block including grooves connected to one of the cradle pieces; and a rail structure including rails connected to the other one of the cradle pieces; and wherein:

the rails of the rail structure extend within the grooves of the bearing block.

* * * * *